US006948744B2

(12) United States Patent
Atansoski et al.

(10) Patent No.: US 6,948,744 B2
(45) Date of Patent: Sep. 27, 2005

(54) EXHAUST VIBRATION DECOUPLING CONNECTOR

(75) Inventors: Josif Atansoski, Ormond Beach, FL (US); Italo DeBlasi, Ormond Beach, FL (US)

(73) Assignee: Microflex, Inc., Ormond Beach, FL (US)

( * ) Notice: Subject to any disclaimer, the term of this patent is extended or adjusted under 35 U.S.C. 154(b) by 0 days.

(21) Appl. No.: 10/983,834

(22) Filed: Nov. 8, 2004

(65) Prior Publication Data

US 2005/0062286 A1 Mar. 24, 2005

Related U.S. Application Data

(62) Division of application No. 10/307,124, filed on Nov. 26, 2002.

(51) Int. Cl.[7] ..... F16L 27/00
(52) U.S. Cl. ..... 285/226; 285/49
(58) Field of Search ..... 285/224, 226, 285/227, 228, 154.5, 49

(56) References Cited

U.S. PATENT DOCUMENTS 2,216,468 A * 10/1940 Farrar ..... 285/226
2,713,503 A * 7/1955 Ekholm ..... 285/226

* cited by examiner

*Primary Examiner*—David Bochna
(74) *Attorney, Agent, or Firm*—The Livingston Firm; Edward M. Livingston; Angela M. Miller

(57) ABSTRACT

An exhaust-vibration decoupling connector has an inlet tube (1) extended downstream from a decoupler inlet (2) to an inlet-tube step (22). The inlet-tube step includes a radially inward extension of the inlet tube to a damper seat (23) that includes further downstream extension of the inlet tube. An outlet tube (4) is extended upstream from a decoupler outlet (5) to an outlet-tube step (24) that includes a radially inward extension of the outlet tube to proximate an outside surface of the damper seat. A vibration damper is positioned removably in a damper fixture (3) that includes the damper seat intermediate the inlet-tube step and the outlet-tube step proximate midway between the decoupler inlet and the decoupler outlet. Surrounding the vibration damper, a decoupler bellows (7) has an upstream bellows attachment (9) proximate an outside periphery of the inlet tube and a downstream bellows attachment (10) proximate an outside periphery of the outlet tube. Enclosing an outside periphery of the decoupler bellows is a flex cover (13) that is extended from proximate the decoupler inlet to the decoupler outlet. The decoupler inlet is articulated for attachment to an exhaust-outlet structure (33) on an engine. The decoupler outlet is articulated for attachment to an exhaust-treatment structure (34).

28 Claims, 5 Drawing Sheets

EXHAUST VIBRATION DECOUPLING CONNECTOR

CROSS REFERENCE

This is a division of application Ser. No. 10/307,124, filed on Nov. 26, 2002.

BACKGROUND OF THE INVENTION

This invention relates to engine-exhaust connectors that employ bellows or bellows-functional apparatuses in combination with mesh-wire washers, gaskets, or other resilient and high-temperature absorbency spacers for decoupling that prevents transfer of exhaust vibration and noise to mufflers, smog-control and other exhaust-downstream devices.

Numerous bellows apparatuses are known for joining flexible conveyances. Many patents and other prior art could be cited.

For specificity of this invention, however, only one, U.S. Pat. No. 6,086,110, granted to Lee, et al. on Jul. 11, 2000 will be referenced in detail. There is no other prior art known to be sufficiently similar to merit anticipatory comparison. The Lee, et al. patent and this invention disclose most nearly the use of a bellows in combination with mesh-wire damping washers to decouple vibration of exhaust of an internal-combustion engine from exhaust-treatment devices and structures that include smog-control devices, mufflers and exhaust pipes. However, the combinations, structures, positional relationships, functional relationships, manufacturing requirements, attachment methods, costs, durability and effectiveness of bellows and mesh-wire washers of this invention and the Lee, et al. patent are all different.

Different structure and working relationship of parts of the Lee, et al. patent and this invention require different manufacturing and application features that set them apart additionally. The Lee, et al. patent requires welding, metalwork bending and tapering interspersed with machining and assembly. It is most suited to integrated production of an entire decoupling system in a single manufacturing facility. Production for the Lee, et al. patent is not readily segmental for outsourcing or competitive participation. It requires high-cost production with interspersed production methods and uses of machinery that inhibit competitive interests from encroachment into OEM or after-market business activities. Its high production cost can increase gross sales which increases profit which benefits its producer, but only as long as proprietary protection and business strength can be maintained adequately.

This invention, however, provides low-cost and easily segmented production that can be out-sourced readily. Also, it can be attached and detached quickly, easily and reliably to exhaust manifolds and to downstream exhaust-treatment, muffler and exhaust-pipe components.

Examples of most-closely related known but different devices are described in the following patent documents:

| Patent No. | Inventor | Issue Date |
|---|---|---|
| U.S. Pat. No. 6,086,110 | Lee, et al. | Jul. 11, 2000 |
| U.S. Pat. No. 5,653,478 | McGurk, et al. | Aug. 5, 1997 |
| U.S. Pat. No. 5,639,127 | Davey | Jun. 17, 1997 |
| U.S. Pat. No. 5,506,376 | Godel | Apr. 9, 1996 |
| U.S. Pat. No. 5,482,330 | Holzhausen | Jan. 9, 1996 |

-continued

| Patent No. | Inventor | Issue Date |
|---|---|---|
| U.S. H1101 | Waclawik | Sep. 1, 1992 |
| U.S. Pat. No. 247,591 | White | Sep. 27, 1881 |
| JP 2-129489 | | 1990 |
| EU 0 681 097 A1 | | Feb. 6, 1995 |
| DE 33 21 382 A1 | | Feb. 16, 1984 |

SUMMARY OF THE INVENTION

Objects of patentable novelty and utility taught by this invention are to provide an exhaust-vibration decoupling connector which:

- is flexible centrally and over a long area to increase use life;
- is highly effective in isolating or decoupling exhaust vibration and noise from exhaust-related engine components;
- can be manufactured at low cost;
- has segmental production features that can be outsourced for competitive production;
- can be assembled and attached to an exhaust system quickly and easily;
- can have long use life; and
- can be detached for maintenance and replacement quickly and easily.

This invention accomplishes these and other objectives with an exhaust-vibration decoupling connector having an inlet tube extended downstream from a decoupler inlet to a damper step. The damper step includes a radially inward extension of the inlet tube to a damper seat that includes further downstream extension of the inlet tube for seating a vibration damper. An outlet tube is extended upstream from a decoupler outlet to a damper restraint that includes a radially inward extension of the outlet tube to proximate an outside surface of the damper step. A vibration damper is positioned on the damper seat intermediate the damper step and the damper restraint at proximate midway between the decoupler inlet and the decoupler outlet. A decoupler bellows includes a bellows upstream connector proximate an outside periphery of the inlet tube and a bellows downstream connector proximate an outside periphery of the outlet tube. The decoupler bellows has a plurality of convolutions intermediate the bellows upstream connector and the bellows downstream connector. Enclosing an outside periphery of the decoupler bellows can be a resilient sleeve that is extended from proximate the bellows upstream connector to proximate the bellows downstream connector. External to the resilient sleeve if used and external to the decoupler bellows is a cover sleeve that is extended from proximate the bellows downstream connector to a predetermined distance from the bellows upstream connector for rigid protection of the decoupler bellows and the resilient sleeve if used. The decoupler inlet is articulated for attachment to an exhaust-outlet structure on an engine. The decoupler outlet is articulated for attachment to an exhaust-treatment structure.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
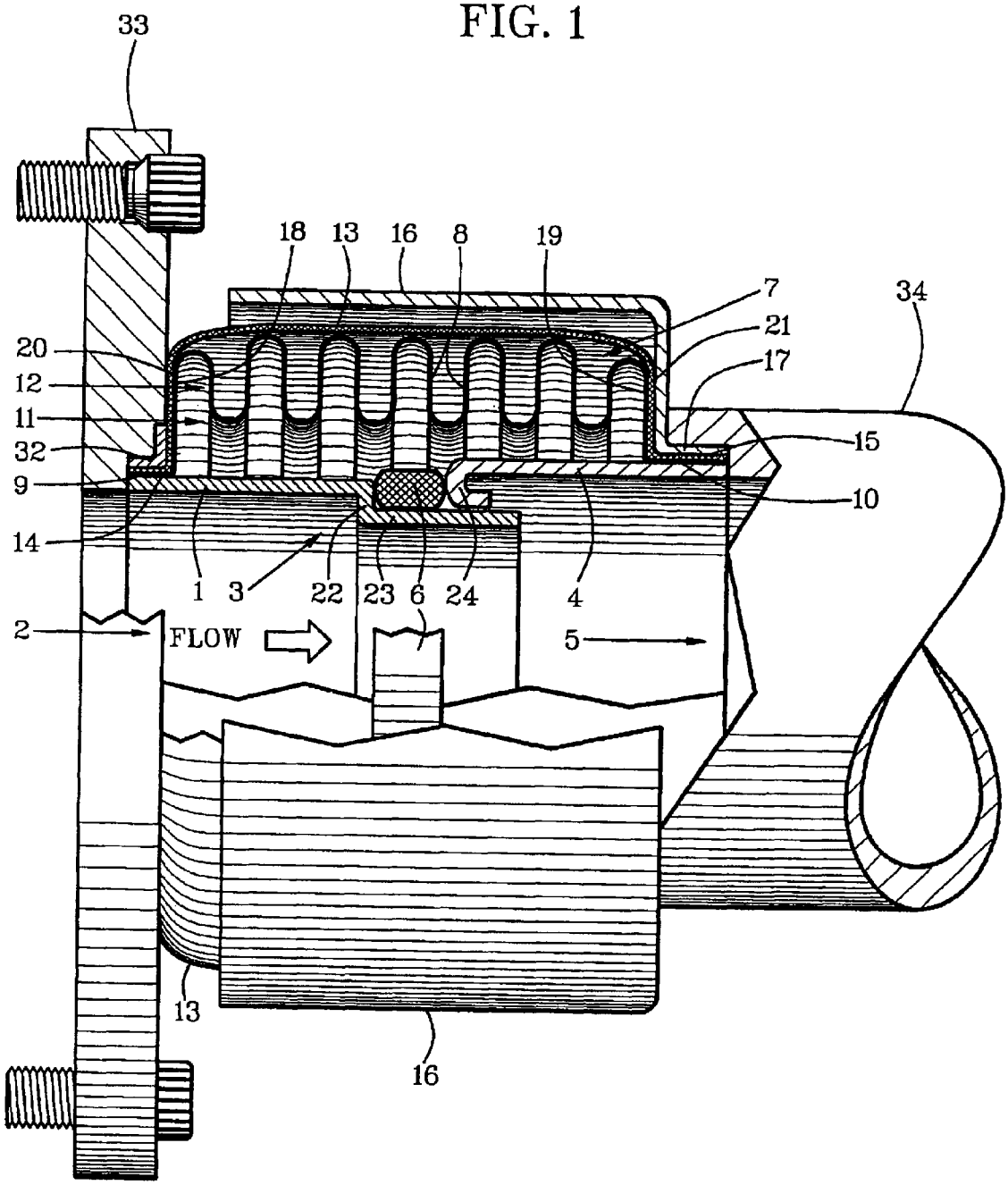
FIG. 1 is a partially cutaway side view of the invention having a flex cover and a cover shield external, to a bellows that has flexibly parallel walls and has a vibration damper that is a mesh-wire washer in a damper fixture midway between a decoupler inlet and a decoupler outlet.

Listed numerically below with reference to the drawings are terms used to describe features of this invention. These terms and numbers assigned to them designate the same features throughout this description.

1. Inlet tube
2. Decoupler inlet
3. Damper fixture
4. Outlet tube
5. Decoupler outlet
6. Mesh-wire washer
7. Bellows
8. Parallel walls
9. Upstream bellows attachment
10. Downstream bellows attachment
11. Bellows inside perimeter
12. Undulations
13. Flex cover
14. Upstream flex attachment
15. Downstream flex attachment
16. Shield sleeve
17. Shield attachment
18. First undulation wall
19. Second undulation wall
20. First flex-cover wall
21. Second flex-cover wall
22. Inlet-tube step
23. Damper seat
24. Outlet-tube step
25. Wave-spring damper
26. Wave-spring washers
27. Helical-spring damper
28. Spring-side damper
29. Helical spring
30. First wall
31. Second wall
32. Braid cap
33. Exhaust-outlet structure
34. Exhaust-treatment structure
35. Mesh-wire ring Referring to FIG. 1, an inlet tube 1 is extended downstream from a decoupler inlet 2 to proximate an upstream portion of a damper fixture 3. An outlet tube 4 is extended upstream from a decoupler outlet 5 to proximate a downstream portion of the damper fixture 3. The damper fixture 3 is proximate midway between the decoupler inlet 2 and the decoupler outlet 5.

A vibration damper, which in this embodiment is a mesh-wire washer 6, is positioned removably in the damper fixture 3. A bellows 7, with preferably parallel walls 8, has an upstream bellows attachment 9 proximate the decoupler inlet 2. The bellows 7 has a downstream bellows attachment 10 proximate the decoupler outlet 5. The bellows 7 has a bellows inside perimeter 11 that is radially outward predeterminedly from a radially outside perimeter of the mesh-wire washer 6 or other vibration damper. The bellows inside perimeter 11 is defined by inside peripheries of undulations 12 of the bellows 7.

A flex cover 13 has an upstream flex attachment 14 proximate the decoupler inlet 2. The flex cover 13 has a downstream flex attachment 15 proximate the decoupler outlet 5. The bellows inside perimeter 11 is radially outward predeterminedly from a radially outside perimeter of the wire-mesh washer 6 or other vibration damper.

A shield sleeve 16 has a shield attachment 17 proximate the decoupler outlet 5. The shield sleeve 16 has a shield inside perimeter that is positioned radially outward predeterminedly from a radially outside perimeter of the flex cover 13.

The upstream bellows attachment 9 includes an upstream bellows sleeve extending downstream axially a predetermined attachment distance from proximate the decoupler inlet 2 to a first undulation wall 18 that is extended radially intermediate the upstream bellows sleeve and a first side of a first of the undulations 12 of the bellows 7.

The downstream bellows attachment 10 includes a downstream bellows sleeve extending upstream axially a predetermined attachment distance from proximate the decoupler outlet 5 to a second undulation wall 19 that is extended radially intermediate the downstream bellows sleeve and a second side of a last of the undulations 12 of the bellows 7.

The upstream bellows sleeve, shown at the upstream bellows attachment 9, includes an inside periphery that is positioned on an outside periphery of a fastener portion of the inlet tube 1. The downstream bellows sleeve, shown at the downstream bellows attachment 10, includes an inside periphery that is positioned removably on an outside periphery of a fastener portion of the outlet tube 4.

The upstream flex attachment 14 includes an upstream flex-cover sleeve extending downstream axially a predetermined attachment distance from proximate the decoupler inlet 2 to a first flex-cover wall 20 that is extended radially intermediate the upstream flex-cover sleeve and a first attachment side of the flex cover 13. The downstream flex attachment 15 includes a downstream flex-cover sleeve extending upstream axially a predetermined attachment distance from proximate the decoupler outlet 5 to a second flex-cover wall 21 that is extended radially intermediate the downstream flex-cover sleeve and a second attachment side of the flex cover 13.

The upstream flex-cover sleeve includes an inside periphery that is positioned removably on an outside periphery of the upstream bellows sleeve. The downstream flex-cover sleeve includes an inside periphery that is positioned removably on an outside periphery of the downstream bellows sleeve.

The inlet tube 1 is circumferential with an inside perimeter and an outside perimeter. The outlet tube 4 is circumferential with an inside periphery and an outside periphery. The inside periphery and the outside periphery of the inlet tube 1 are predeterminedly smaller than the inside periphery and the outside periphery of the outlet tube 4. The damper fixture 3 can include an inlet-tube step 22 extended radially inward to a damper seat 23 having an axial downstream extension of the inlet tube 1. The damper fixture 3 can include an outlet-tube step 24 extended radially inward to predeterminedly proximate an outside periphery of the damper seat 23. The inlet-tube step 22 includes a first side of the damper fixture 3 and the outlet-tube step 24 includes a second side of the damper fixture 3.

Figure 5:
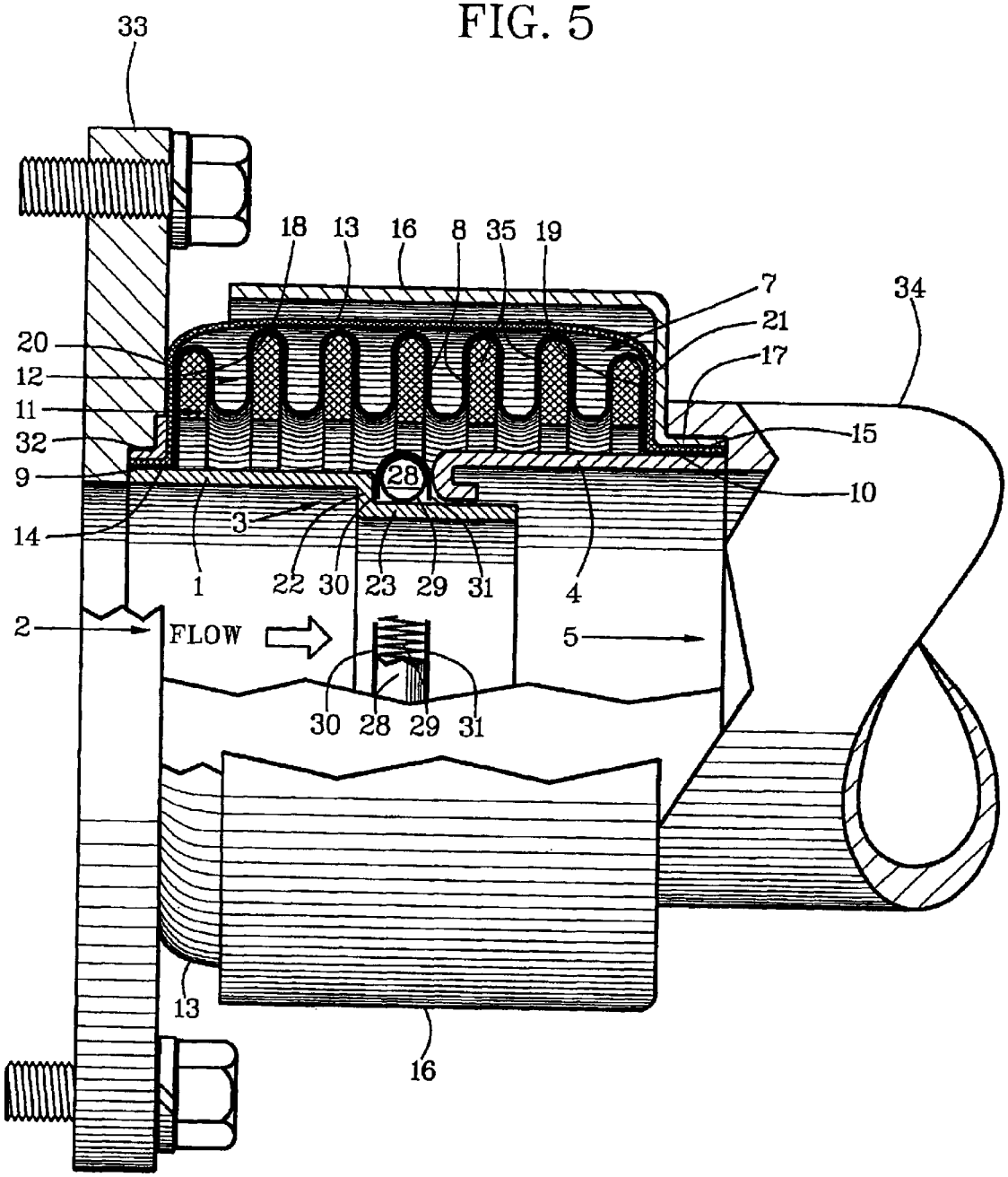
FIG. 5 is a partially cutaway side view of the invention with the flex cover and the cover shield-external to the bellows that has vibration-damping material that can be mesh-wire washers in the undulations of the bellows and includes a vibration damper that is a spring-side damper in the damper fixture.

The outlet-tube step 24 can be articulated to allow axial and pivotal travel of the outlet tube 4 in relation to the inlet tube 1 predeterminedly. To illustrate this pivotal feature, the outlet-tube step 24 in FIG. 5 is depicted to be arcuate proximate the damper seat 23.

Figure 3:
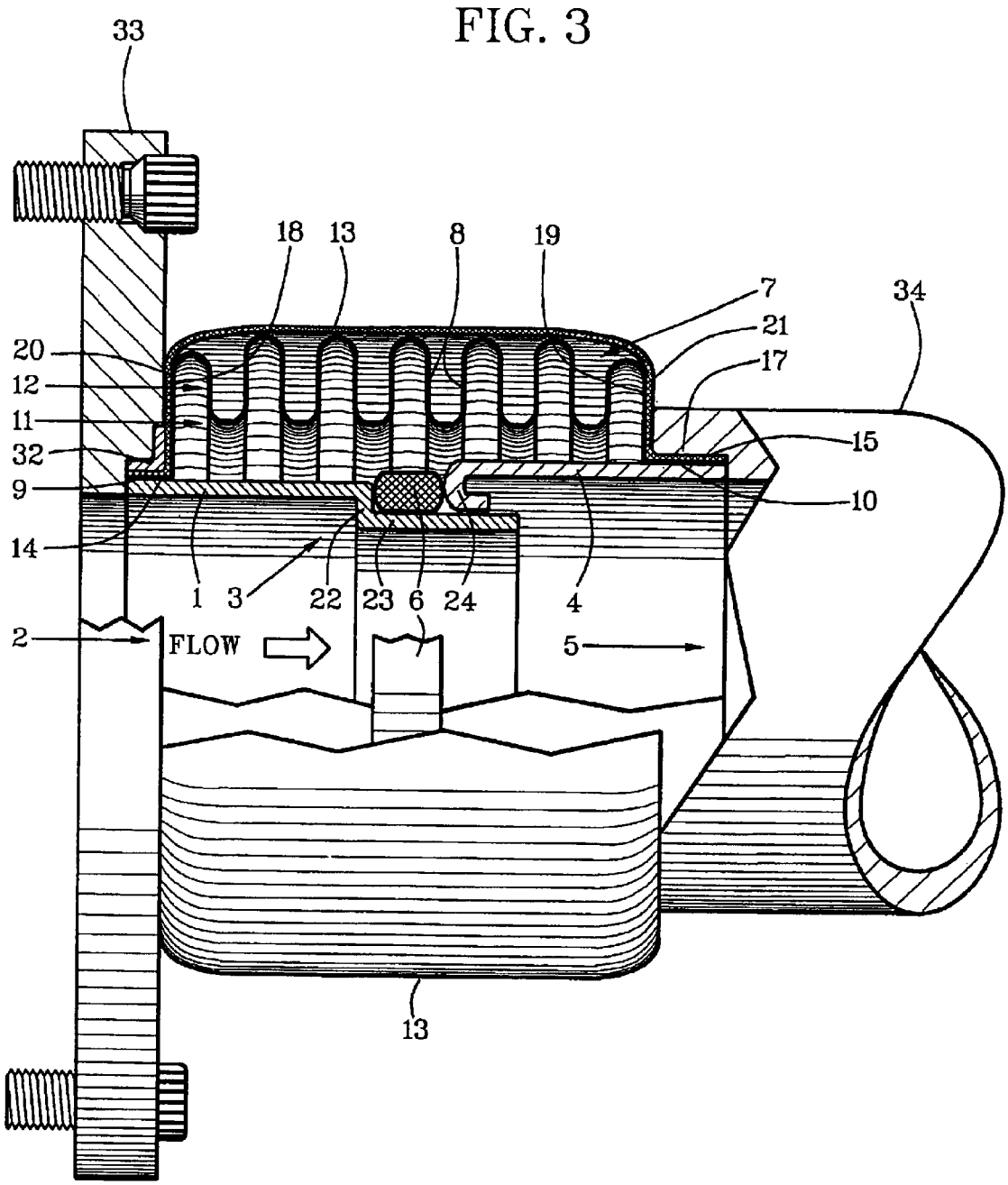
FIG. 3 is a partially cutaway side view of the invention without the cover shield external to the bellows and includes the vibration damper that is the mesh-wire washer in the damper fixture.

For the embodiments of this invention shown in FIGS. 1 and 3, the vibration damper includes the mesh-wire washer 6 having an inside periphery that is positioned removably on the damper seat 23, an outside periphery that is predeterminedly smaller than the bellows inside perimeter 11, a first side proximate the inlet-tube step 22, and a second side proximate the outlet-tube step 24.

Figure 2:
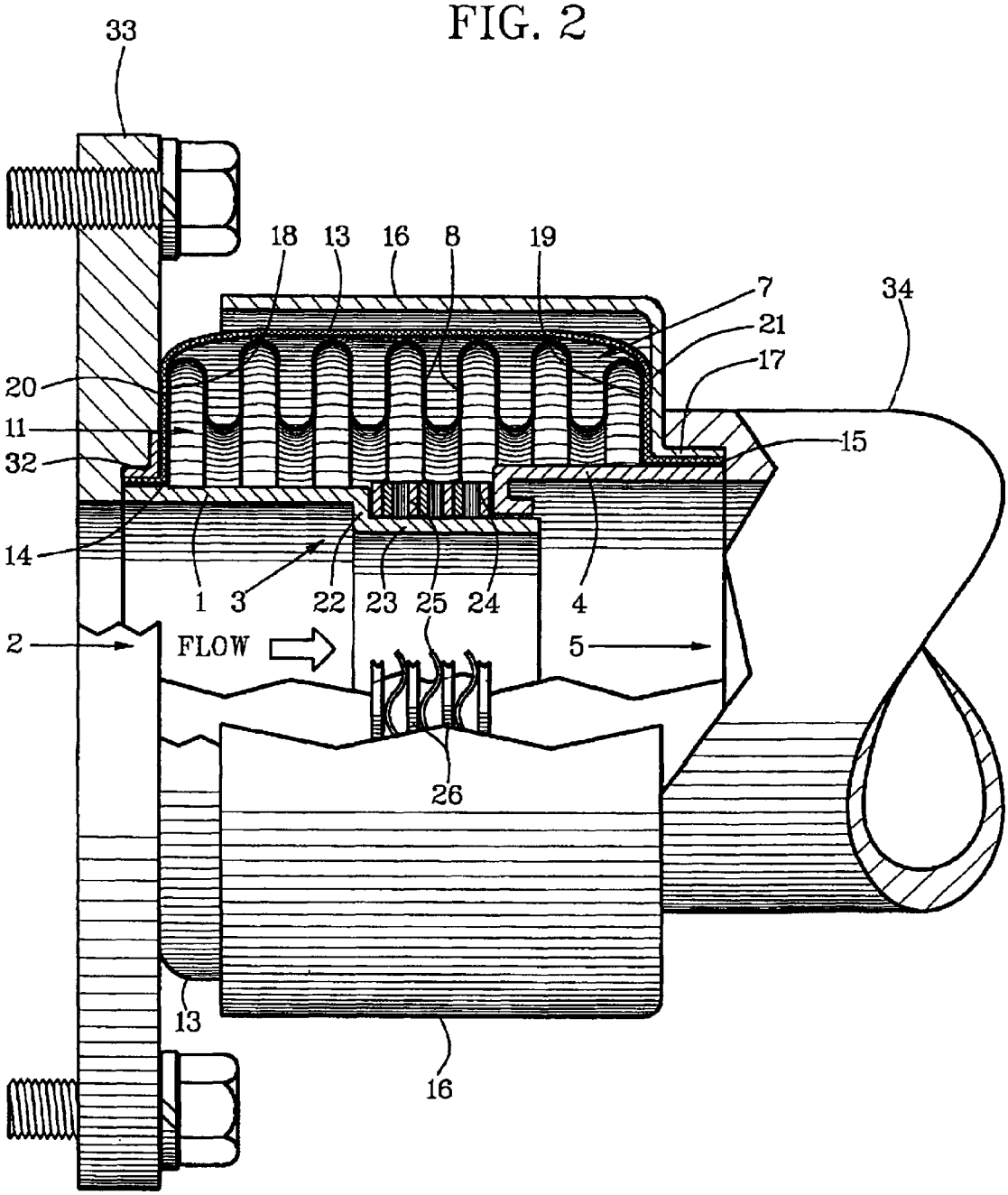
FIG. 2 is a partially cutaway side view of the invention having the flex cover and the cover shield external to the a vibration damper that includes wave springs between wave-spring washers.

For the embodiment shown in FIG. 2, the vibration damper includes one or more wave springs 25 that can include wave-spring washers 26 that are in detachably sealed contact with the inlet-tube step 22 and the outlet-tube step 24.

Figure 4:
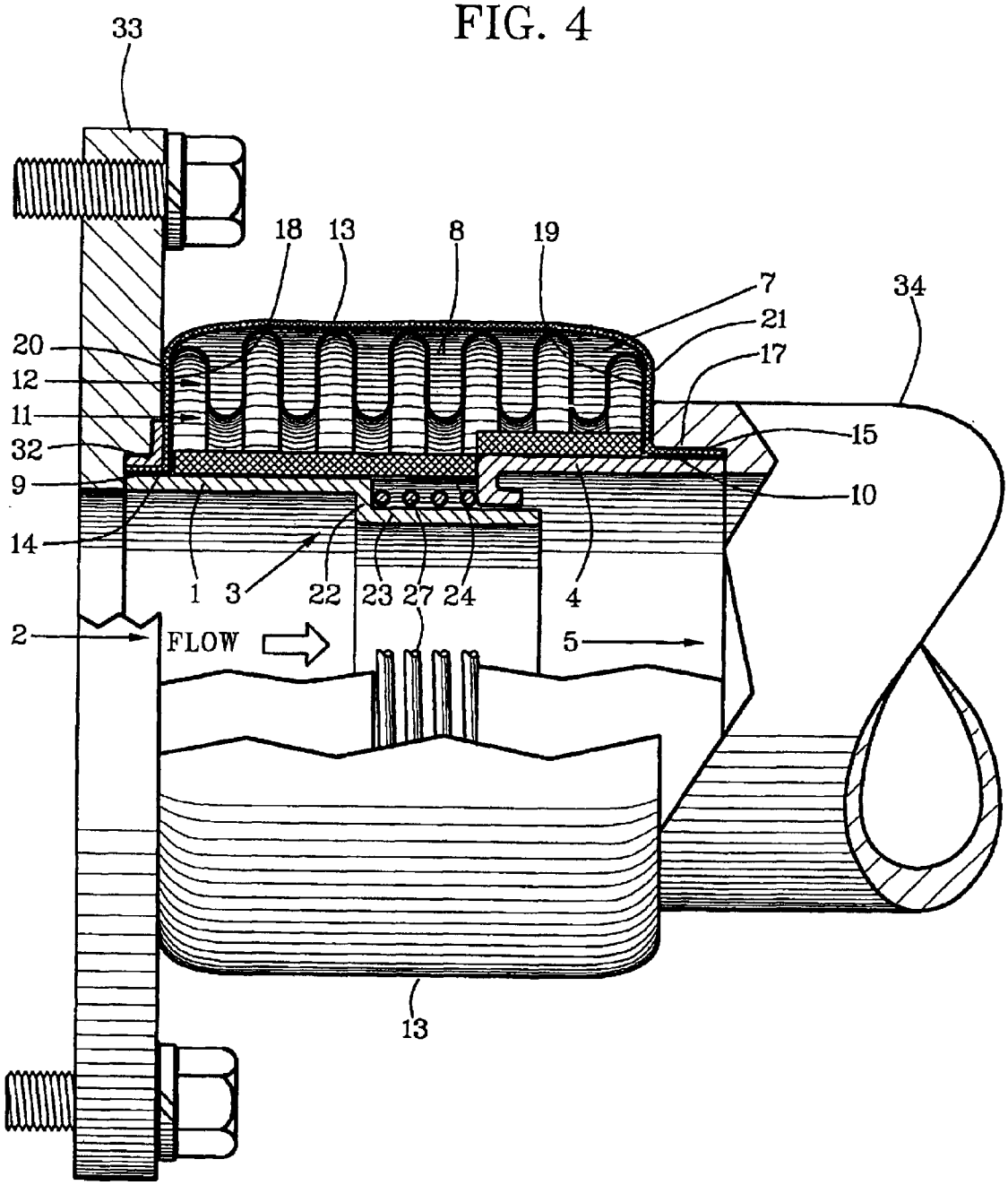
FIG. 4 is a partially cutaway side view of the invention without the flex cover and the cover shield external to the bellows and with a vibration damper that includes a helical spring.

For the embodiments shown in FIG. 4, the vibration damper includes a helical-spring damper 27.

For the embodiment shown in FIG. 5, the vibration damper includes a spring-side damper 28 having a helical spring 29 in a circumferential channel with a first wall 30 adjacent to the inlet-tube step 22 and a second wall 31 adjacent to the outlet-tube step 24. The circumferential channel is arcuate intermediate the first wall 30 and the second wall 31. The first wall 30 and the second wall 31 have inside peripheries proximate the outside periphery of the damper seat 23.

For the embodiments shown in FIGS. 1–5, the flex cover 13 includes a heat-resistant and flexible material that is reinforced with wire network predeterminedly. The flex cover 13 can include a braided-wire material. The flex cover 13 can include a braid cap 32 that is positioned intermediate the upstream flex attachment 14 and predetermined exhaust-outlet structure 33 to which the exhaust-vibration decoupling connector is attachable.

As shown in FIGS. 1–5, the upstream bellows attachment 9 is articulated for sealed attachment to the predetermined exhaust-outlet structure 33. The downstream bellows attachment 10 is articulated for sealed attachment to a predetermined exhaust-treatment structure 34 that is fluidly downstream from the exhaust-outlet structure.

The upstream bellows attachment 9 is disposed a snug-fit distance from the downstream bellows attachment 10 for fitting snugly intermediate the exhaust-outlet structure 33 and the-exhaust-treatment structure 34 predeterminedly.

The exhaust-outlet structure 33 normally includes an exhaust flange of sorts. The exhaust-treatment structure 34 normally includes a conveyance tube or pipe from a smog-control device, a muffler or an exhaust pipe. The exhaust-outlet structure 33 also can include downstream connections for a smog-control device or muffler. These structures are shown figuratively without specificity of attachment structures for particular engines or exhaust-treatment devices.

For the embodiments shown in FIGS. 1–2 and 5, the shield sleeve 16 has a shield length that is less than the snug-fit distance for allowing axial distance change between the decoupler inlet 2 and the decoupler outlet 5 and for allowing pivotal movement of the decoupler outlet 5 predeterminedly.

For the embodiments shown in FIGS. 1–5, the bellows 7 includes flexibly parallel walls 8 intermediate arcuately flexible floors and roofs.

Referring to FIG. 5, the bellows 7 can include damping filler intermediate internal walls which include the parallel walls 8 of undulations 12. The damping filler can include mesh-wire rings 35.

A new and useful exhaust-vibration decoupling connector having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An exhaust-vibration decoupling connector comprising:

an inlet tube extended downstream from a decoupler inlet to proximate an upstream portion of a damper fixture;

an outlet tube extended upstream from a decoupler outlet to proximate a downstream portion of the damper fixture;

the damper fixture being proximate midway between the decoupler inlet and the decoupler outlet;

a vibration damper positioned removably in the damper fixture;

a bellows having an upstream bellows attachment proximate the decoupler inlet;

the bellows having a downstream bellows attachment proximate the decoupler outlet;

the bellows having a bellows inside perimeter that is positioned radially outward predeterminedly from a radially outside perimeter of the vibration damper;

the bellows inside perimeter including inside peripheries of undulations of the bellows;

a flex cover having an upstream flex attachment proximate the decoupler inlet;

the flex cover having a downstream flex attachment proximate the decoupler outlet;

the flex cover having a cover inside perimeter that is positioned proximate a bellows outside perimeter;

the flex cover includes a braid cap that is positioned intermediate the upstream flex attachment and an exhaust-outlet structure to which the exhaust-vibration decoupling connector is attachable;

the flex cover having a first flex-cover wall having a predetermined height;

the flex cover having a second flex-cover wall having a predetermined height;

the braid cap extending no more than the height of the first flex-cover wall; and a shield sleeve having a shield attachment proximate the decoupler outlet; and the shield sleeve having a shield inside perimeter that is positioned radially outward predeterminedly from a radially outside perimeter of the flex cover.

2. The exhaust-vibration decoupling connector of claim 1 wherein:

the upstream bellows attachment includes an upstream bellows sleeve extending downstream axially a predetermined attachment distance from proximate the decoupler inlet to a first undulation wall that is extended radially intermediate the upstream bellows sleeve and a first side of a first undulation of the bellows;

the downstream bellows attachment includes a downstream bellows sleeve extending upstream axially a predetermined attachment distance from proximate the decoupler outlet to a second undulation wall that is extended radially intermediate the downstream bellows sleeve and a second side of a last undulation of the bellows;

the upstream bellows sleeve includes an inside periphery that is positioned removably on an outside periphery of a fastener portion of the inlet tube; and the downstream bellows sleeve includes an inside periphery that is positioned removably on an outside periphery of a fastener portion of the outlet tube.

3. The exhaust-vibration decoupling connector of claim 2 wherein:

the upstream flex attachment includes an upstream flex-cover sleeve extending downstream axially a predetermined attachment distance from proximate the decoupler inlet to the first flex-cover wall that is extended radially intermediate the upstream flex-cover sleeve and a first attachment side of the flex cover; and the downstream flex attachment includes a downstream flex-cover sleeve extending upstream axially a predetermined attachment distance from proximate the decoupler outlet to the second flex-cover wall that is extended radially intermediate the downstream flex-cover sleeve and a second attachment side of the flex cover.

4. The exhaust-vibration decoupling connector of claim 3 wherein:

the upstream flex-cover sleeve includes an inside periphery that is positioned removably on an outside periphery of the upstream bellows sleeve; and the downstream flex-cover sleeve includes an inside periphery that is positioned removably on an outside periphery of the downstream bellows sleeve.

5. The exhaust-vibration decoupling connector of claim 1 wherein:

the inlet tube is circumferential with an inside periphery and an outside periphery;

the outlet tube is circumferential with an inside periphery and an outside periphery;

the inside periphery and the outside periphery of the inlet tube are predeterminedly smaller than the inside periphery and the outside periphery of the outlet tube;

the damper fixture includes an inlet-tube step extended radially inward to a damper seat having an axial downstream extension of the inlet tube;

the damper fixture includes an outlet-tube step extended radially inward to predeterminedly proximate an outside periphery of the damper seat;

the inlet-tube step includes a first side of the damper fixture; and the outlet-tube step includes a second side of the damper fixture.

6. The exhaust-vibration decoupling connector of claim 5 wherein:

the outlet-tube step is articulated to allow axial and pivotal travel of the outlet tube in relation to the inlet tube predeterminedly.

7. The exhaust-vibration decoupling connector of claim 5 wherein:

the vibration damper includes a mesh-wire washer having an inside periphery that is positioned removably on the damper seat, an outside periphery that is predeterminedly smaller than the bellows inside periphery, a first side proximate the inlet-tube step and a second side proximate the outlet-tube step.

8. The exhaust-vibration decoupling connector of claim 5 wherein:

the vibration damper includes a wave-spring damper having one or more wave springs intermediate wave-spring washers in detachably sealed contact with the inlet-tube step and the outlet-tube step.

9. The exhaust-vibration decoupling connector of claim 5 wherein:

the vibration damper includes a helical-spring damper;

the helical-spring damper has a first side in detachable contact with the inlet-tube step and a second side in detachably contact with the outlet-tube step.

10. The exhaust-vibration decoupling connector of claim 1 and further comprising:

the flex cover includes a heat-resistant and flexible material that is reinforced with wire network predeterminedly.

11. The exhaust-vibration decoupling connector of claim 1 wherein:

the flex cover includes braided-wire material.

12. The exhaust-vibration decoupling connector of claim 1 wherein:

the upstream bellows attachment is articulated for sealed attachment to a predetermined exhaust-outlet structure; and the downstream bellows attachment is articulated for sealed attachment to a predetermined exhaust-treatment structure that is fluidly downstream from the exhaust-outlet structure.

13. The exhaust-vibration decoupling connector of claim 12 wherein:

the upstream bellows attachment is disposed a snug-fit distance from the downstream bellows attachment for fitting snugly intermediate the exhaust-outlet structure and the exhaust-treatment structure predeterminedly.

14. The exhaust-vibration decoupling connector of claim 13 wherein:

the shield sleeve has a shield length that is less than the snug-fit distance for allowing axial distance change between the decoupler inlet and the decoupler outlet and for allowing pivotal movement of the decoupler outlet predeterminedly.

15. The exhaust-vibration decoupling connector of claim 1 wherein:

the bellows includes flexibly parallel walls intermediate arcuately flexible floors and roofs.

16. The exhaust-vibration decoupling connector of claim 15 wherein:

the bellows includes oppositely disposed ends that are buttressed against oppositely disposed end walls of the flex cover.

17. The exhaust-vibration decoupling connector of claim 1 wherein:

the bellows includes damping filler intermediate internal walls of undulations of the bellows.

18. The exhaust-vibration decoupling connector of claim 17 wherein:

the damping filler includes mesh wire.

19. An exhaust-vibration decoupling connector comprising:

an inlet tube extended downstream from an upstream portion of the inlet tube proximate a decoupler inlet to proximate an upstream portion of a damper fixture;

an outlet tube extended upstream from a downstream portion of the outlet tube proximate a decoupler outlet to proximate a downstream portion of the damper fixture;

the damper fixture being proximate midway between the decoupler inlet and the decoupler outlet;

a vibration damper positioned removably in the damper fixture;

a bellows having an upstream bellows attachment proximate the decoupler inlet;

the bellows having a downstream bellows attachment proximate the decoupler outlet;

the bellows having a bellows inside perimeter that is positioned radially outward predeterminedly from a radially outside perimeter of the vibration damper;

the bellows inside perimeter including inside peripheries of the bellows; a flex cover having an upstream flex attachment proximate the decoupler inlet;

the flex cover having a downstream flex attachment proximate the decoupler outlet;

the flex cover includes a braid cap that is positioned intermediate the upstream flex attachment and an exhaust-outlet structure to which the exhaust-vibration decoupling connector is attachable;

the flex cover having a first flex-cover wall having a predetermined height;

the flex cover having a second flex-cover wall having a predetermined height;

the braid cap extending no more than the height of the first flex-cover wall; and the flex cover having a cover inside perimeter that is positioned proximate a bellows outside perimeter.

20. The exhaust-vibration decoupling connector of claim 19 wherein:

the upstream bellows attachment includes an upstream bellows sleeve extending downstream axially a predetermined attachment distance from proximate the decoupler inlet to a first undulation wall that is extended radially intermediate the upstream bellows sleeve and a first side of a first undulation of the bellows;

the downstream bellows attachment includes an downstream bellows sleeve extending upstream axially a predetermined attachment distance from proximate the decoupler outlet to a second undulation wall that is extended radially intermediate the downstream bellows sleeve and a second side of a last undulation of the bellows;

the upstream bellows sleeve includes an inside periphery that is positioned removably on an outside periphery of a fastener portion of the inlet tube;

the downstream bellows sleeve includes an inside periphery that is positioned removably on an outside periphery of a fastener portion of the outlet tube;

the inlet tube is circumferential with an inside periphery and an outside periphery;

the outlet tube is circumferential with an inside periphery and an outside periphery;

the inside periphery and the outside periphery of the inlet tube are predeterminedly smaller than the inside periphery and the outside periphery of the outlet tube;

the damper fixture includes an inlet-tube step extended radially inward to a damper seat having an axial downstream extension of the inlet tube;

the damper fixture includes an outlet-tube step extended radially inward to predeterminedly proximate an outside periphery of the damper seat;

the inlet-tube step includes a first side of the damper fixture; and the outlet-tube step includes a second side of the damper fixture.

21. The exhaust-vibration decoupling connector of claim 20 wherein:

the outlet-tube step is articulated to allow axial and pivotal travel of the outlet tube in relation to the inlet tube predeterminedly.

22. The exhaust-vibration decoupling connector of claim 20 wherein:

the vibration damper includes a mesh-wire washer having an inside periphery that is positioned removably on the damper seat, an outside periphery that is predeterminedly smaller than the bellows inside periphery, a first side proximate the inlet-tube step, and a second side proximate the outlet-tube step.

23. The exhaust-vibration decoupling connector of claim 20 wherein:

the vibration damper includes a wave-spring damper.

24. The exhaust-vibration decoupling connector of claim 19 wherein:

the upstream bellows attachment is articulated for sealed attachment to a predetermined exhaust-outlet structure; and the downstream bellows attachment is articulated for sealed attachment to a predetermined exhaust-treatment structure that is fluidly downstream from the exhaust-outlet structure.

25. The exhaust-vibration decoupling connector of claim 19 wherein:

the upstream bellows attachment is disposed a snug-fit distance from the downstream bellows attachment for fitting snugly intermediate the exhaust-outlet structure and the exhaust-treatment structure predeterminedly.

26. The exhaust-vibration decoupling connector of claim 19 wherein:

the bellows includes flexibly parallel walls intermediate arcuately flexible floors and roofs.

27. The exhaust-vibration decoupling connector of claim 19 wherein:

the bellows includes damping filler intermediate internal walls of undulations of the bellows.

28. The exhaust-vibration decoupling connector of claim 19 wherein:

the damping filler includes mesh-wire rings.

* * * * *